US006614347B2

(12) United States Patent
Tanguay

(10) Patent No.: US 6,614,347 B2
(45) Date of Patent: Sep. 2, 2003

(54) APPARATUS AND METHOD FOR PROVIDING ALARM SYNCHRONIZATION AMONG MULTIPLE ALARM DEVICES

(75) Inventor: William Peter Tanguay, Downers Grove, IL (US)

(73) Assignee: Ranco Inc., Wilmington, DE (US)

( * ) Notice: Subject to any disclaimer, the term of this patent is extended or adjusted under 35 U.S.C. 154(b) by 0 days.

(21) Appl. No.: 09/771,687

(22) Filed: Jan. 30, 2001

(65) Prior Publication Data

US 2002/0101344 A1 Aug. 1, 2002

(51) Int. Cl.[7] ..... G08B 29/00

(52) U.S. Cl. ..... 340/508; 340/512; 340/506; 340/532; 340/825.2; 340/539; 340/632

(58) Field of Search ..... 340/508, 506, 340/505, 507, 509, 512, 514, 532, 518, 511, 825.2, 628, 632, 331, 332, 513, 825.25, 539; 315/241

(56) References Cited

U.S. PATENT DOCUMENTS

| | | | | | |
|---|---|---|---|---|---|
| 3,925,763 | A | * | 12/1975 | Wadhwani et al. | 340/518 |
| 3,950,739 | A | * | 4/1976 | Campman | 340/514 |
| 4,367,458 | A | * | 1/1983 | Hackett | 340/539 |
| 4,412,211 | A | * | 10/1983 | Lautzenheiser et al. | 340/514 |
| 4,531,114 | A | | 7/1985 | Topol et al. | |
| 4,536,748 | A | | 8/1985 | Tonello | |
| 4,665,383 | A | | 5/1987 | Desjardins | |
| 4,673,920 | A | * | 6/1987 | Ferguson et al. | 340/521 |
| 4,727,359 | A | * | 2/1988 | Yuchi et al. | 340/518 |
| 4,812,820 | A | * | 3/1989 | Chatwin | 340/518 |
| 5,508,690 | A | * | 4/1996 | Shur et al. | 340/825.16 |
| 5,686,885 | A | * | 11/1997 | Bergman | 340/514 |
| 5,686,896 | A | * | 11/1997 | Bergman | 340/636 |
| 5,886,620 | A | * | 3/1999 | Stewart et al. | 340/332 |
| 5,893,369 | A | | 4/1999 | LeMole | |
| 5,982,275 | A | * | 11/1999 | Kosich | 340/331 |
| 6,028,513 | A | * | 2/2000 | Addy | 340/539 |
| 6,144,310 | A | * | 11/2000 | Morris | 340/692 |
| 6,281,789 | B1 | * | 8/2001 | Furtado et al. | 340/506 |

* cited by examiner

*Primary Examiner*—Daniel J. Wu
*Assistant Examiner*—Daniel Previl
(74) *Attorney, Agent, or Firm*—Andrus, Sceales, Starke & Sawall, LLP

(57) ABSTRACT

A method and apparatus for synchronizing a series of interconnected alarm devices. The alarm device detecting an alarm condition produces a signal having a distinct rising edge which is detected at each of the remaining alarm devices. A pulsed alarm signal having a fixed number of pulses is generated at each remaining device in response to the rising edge. A reset signal from the alarm device detecting the alarm condition resets each of the remaining alarm devices after each fixed number of pulses is produced so that each of said devices has a pulsed alarm signal which begins and ends at substantially the same time.

28 Claims, 4 Drawing Sheets

APPARATUS AND METHOD FOR PROVIDING ALARM SYNCHRONIZATION AMONG MULTIPLE ALARM DEVICES

BACKGROUND OF THE INVENTION

The present invention relates to residential alarm systems for detecting dangerous conditions in multiple locations within a building. Specifically, a method and system for synchronizing audible warning appliances which are distributed throughout a home or other facility is described.

Alarm systems which detect dangerous conditions in a home, such as the presence of smoke, or carbon dioxide, are extensively used to prevent death or injury. In recent years, it has been the practice to interconnect different alarm units which are located in different rooms of a person's home. Specifically, smoke detecting systems for warning inhabitants of a fire have been installed in individual rooms of a home and interconnected so that all alarms will sound if one alarm detects any combustion products produced by a fire. In this way, individuals located away from the source of combustion products are alerted to the danger of fire, as well as those in closer proximity to the fire. In accordance with various safety codes, these devices are equipped with a light-emitting source, so that the alarm which detects the smoke or other dangerous condition will provide a visual indication of the source of the dangerous conditions. In this way, it is possible for responding fire personnel to determine which of the units is sensing the alarm condition while the remaining devices distributed throughout the home provide an audible alarm.

The system interconnecting the various alarm units in a dwelling relies upon the sensing alarm to apply a voltage to a common conductor interconnecting each of the distributed alarm units. When the applied voltage is detected to be above a threshold value, typically three volts, the remaining alarms begin sounding their audible signaling horn. The common conductor carries a signaling voltage from the sensing alarm to each of the remaining alarms for triggering the audible responses from the remaining remote alarm devices.

The input/output connection to the common conductor is equipped with a filter to minimize the possibility of the random triggering of the alarm by voltages induced on the common conductor, as well as to minimize the effects of voltage spikes on the neutral of the power line which may inadvertently signal connected smoke detectors into an alarm condition.

The prior art interconnected smoke detector alarms included a test capability at each alarm. When an individual in a room having a smoke alarm activates the test feature, an audible signal is produced from the smoke alarm being tested. As long as the user releases the test switch within a brief period of time, the other units throughout the facility are not activated. However, the presence of the input filter of each smoke alarm connected to the common conductor resulted in a latent electrical charge being maintained on the filter capacitor which required several seconds to discharge. Following a test, or actual alarm condition which is transmitted on the common conductor, the input filters may remain charged to the point where each remote alarm unit can remain in a temporary alarm condition resulting in an objectionable false alarm.

The foregoing problem has been addressed in the prior art by applying a momentary low impedance from the common conductor to circuit ground following the generation of an alarm signal on the common conductor, quickly discharging the filter capacitors, avoiding the consequence of an inadvertent false alarm due to the stored charge.

The detected alarm condition in future alarm systems may represent one of several types of alarms. For instance, the danger of fire may be sensed with a smoke detector, and the danger from carbon monoxide poisoning may be sensed with a gas detector. Various authorities having jurisdiction have required manufacturers to generate different audible signaling patterns so that people hearing the respective alarms can distinguish between the different sensed dangers.

Using signaling formats of specific temporal patterns is made difficult if all detectors are not synchronized to produce the same audible pattern of warning signals. The unsynchronized alarms produce a cacophony of sounds which make discerning any particular pattern difficult.

The effectiveness of the connected alarm devices could, therefore, be enhanced by synchronizing the audible responses provided by each alarm device when responding to a remote unit which is detecting an alarm condition. The foregoing features which permit self tests to be made at each alarm, and which discharge each of the filter capacitors of the connected alarms following a test, provide the basis for a circuit which can be modified to permit synchronous signaling by each of the connected alarms.

BRIEF SUMMARY OF THE INVENTION

The present invention provides an ability to synchronize the audible alarm sounds of interconnected alarm devices to more clearly distinguish the alarm as being either a smoke condition, or a carbon monoxide condition, or any other alarm condition which may be sensed at a given location, avoiding the cacophony of unsynchronized audible signals which obscure the nature of the detected condition.

An alarm device for responding to a locally generated alarm condition, which also responds to a remotely detected alarm condition, is provided by the invention. The alarm device includes a sensor which detects a local alarm condition such as smoke, carbon monoxide, explosive gas mixtures, etc., and sounds an audible, pulsed alarm when a dangerous condition is sensed. Each alarm device is equipped with a signal detector connected to a common conductor which detects an alarm voltage on the common conductor generated by a remote alarm device detecting an alarm condition. A transmitter circuit at the remote alarm device sends a pulsed signal to each connected alarm device, which is time synchronous with the audible alarm being generated by the remote alarm device, initiating a pulsed audible signal at each of the alarm devices. By generating a synchronized audible signal at each location, the homeowner, resident or the responding emergency personnel can quickly and correctly identify the specific alarm condition.

DETAILED DESCRIPTION OF THE PREFERRED EMBODIMENT

Figure 1:
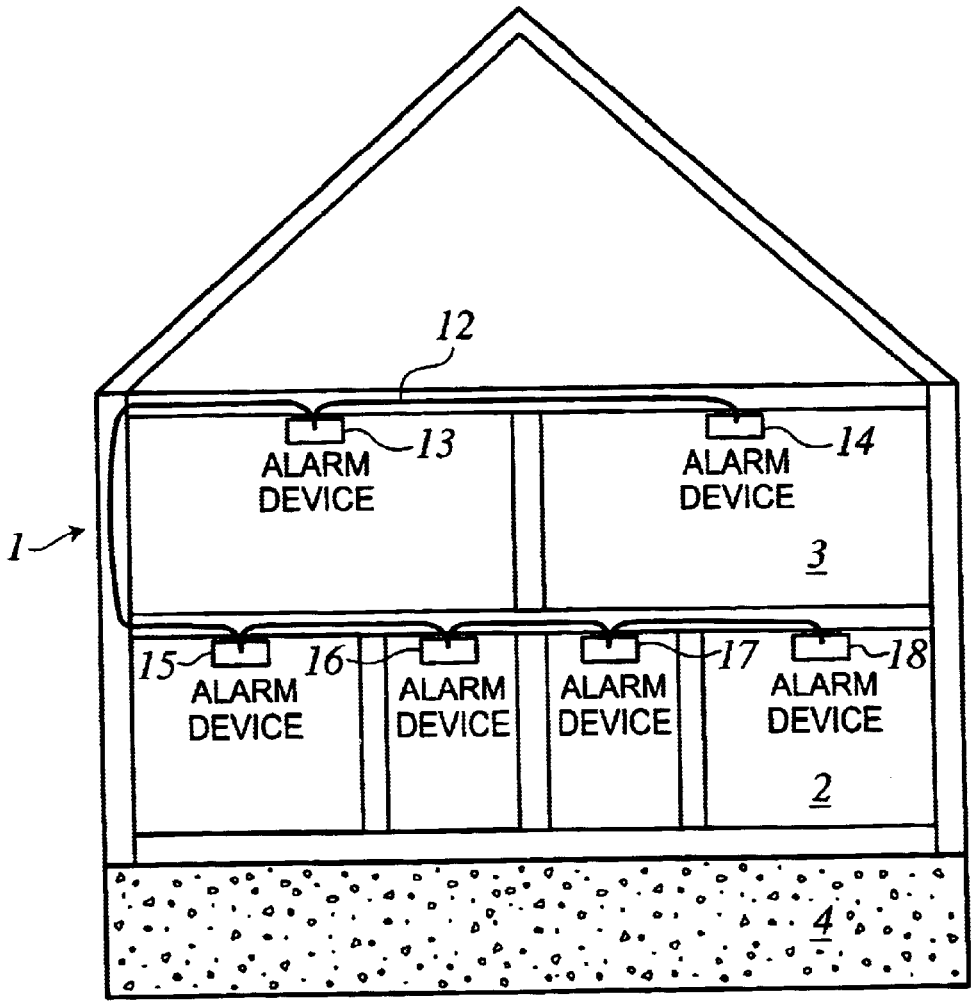
FIG. 1 is the general view of a plurality of remote alarm devices which are interconnected with a common conductor 12.

Referring now to FIG. 1, a facility 1 is shown having a plurality of levels 2, 3 and 4 with rooms on each level. Remote sensing devices 13–18 are located in each room of the facility 1, and are interconnected by a common conductor 12. It is understood that each of the units 13–18 have a common connection, through either the neutral of the facility power supply, or by a second conductor (not shown).

Each of the alarm devices 13–18 detect a dangerous condition, such as smoke being generated from a fire. The alarm devices 13–18 produce a pulsed audible sound which may be heard within the room in which the device is located. When an alarm condition is detected by one of the devices (the alarm sensing device), the remaining alarm devices (remote alarm devices) also produce, at the same pulse width and pulse period, an audible alarm signal synchronized with the remaining alarm signals so that an occupant of any room may clearly determine the nature of the alarm.

Figure 2A:
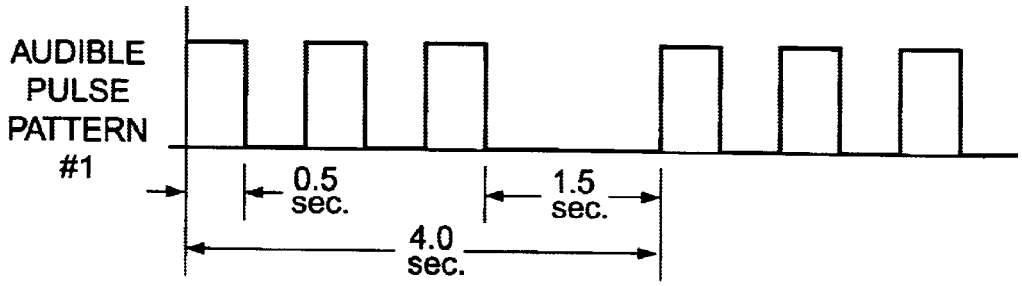
FIG. 2A represents an exemplary standard audible alarm signal produced by each of the alarm devices of FIG. 1.
Figure 2B:
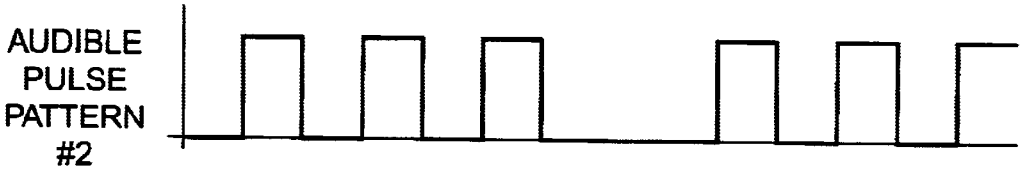
FIG. 2B illustrates an exemplary unsynchronized audible alarm pulse signal produced by another interconnected remote device.
Figure 2C:
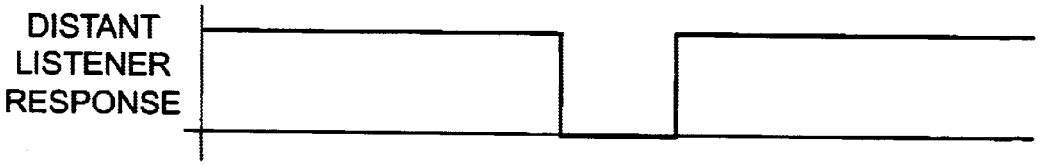
FIG. 2C illustrates a hypothetical audible signal produced by the acoustical sum of signals 2A and 2B due to a lack of synchronization on pulsed alarm signals emanating from different alarm devices.

The effect of not synchronizing the audible alarm signals can be shown with reference to FIGS. 2A, 2B and 2C. In accordance with a standard format for generating audible alarm signals in a smoke detector, three pulses having an on time of 0.5 seconds separated by an off time of 0.5 seconds are generated in response to the detected alarm condition. The temporal signal shown in FIG. 2A has an off period following the third pulse which is approximately 1.5 seconds. If the alarm condition persists, either in response to the actual detection of an alarm condition, or when the self-test feature is invoked by the user, additional groups of pulsed signals of the format shown in FIG. 2A are subsequently produced on the common conductor 12.

FIG. 2B illustrates the generation of the same audible signal by a remote alarm device which receives an alarm signal on common conductor 12. The alarm device responds by producing the same pattern of audible pulses. Under current interconnect practices, the remote alarm devices are turned on, and not synchronized with respect to the initiating alarm device audible signals. Accordingly, to the occupant, depending on his location within the facility, the unsynchronized signals from the alarm devices, shown in FIG. 2A and FIG. 2B, can vary from an in phase to an out of phase condition. To the occupant, only a continuous audible signal is generated as shown in FIG. 2C when the two alarm devices are producing out of phase audible signals at the listener's location, rather than individual pulses of a regular pulsed frequency, obscuring the nature of the alarm condition. Once the initiating alarm device ceases sending the alarm signal on conductor 12, a charge dump signal is applied to conductor 12, to remove all of the latent charge which has accumulated on each remote alarm device input filter capacitor.

The present invention synchronizes each of the audible signals produced from each alarm device so that, to an occupant, it is clear what the nature of the alarm condition is.

Figure 3A:
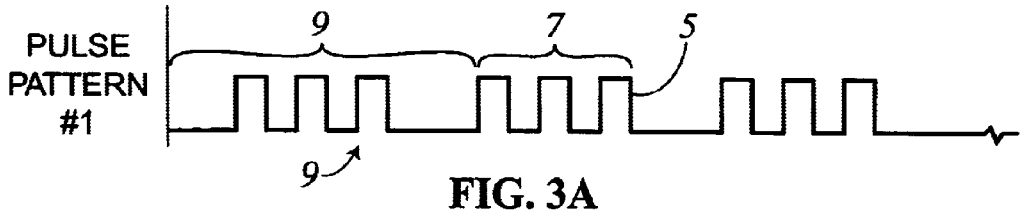
FIG. 3A illustrates a standard repeating pattern of pulsed temporal alarm signals.
Figure 3B:
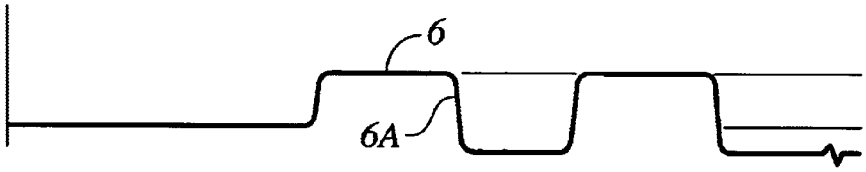
FIG. 3B illustrates the voltage applied to a common conductor interconnecting each of the remote alarm devices by an alarm device sensing an alarm condition in accordance with one embodiment of the invention.
Figure 3C:
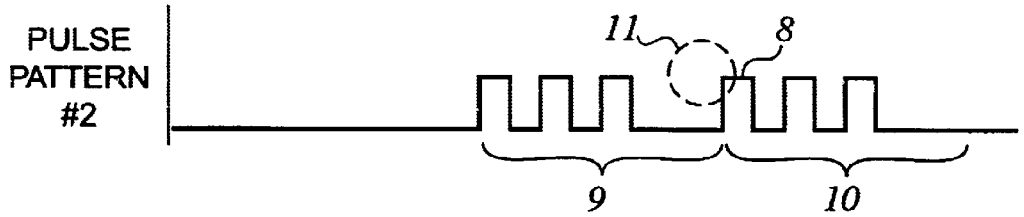
FIG. 3C illustrates the relationship between the pulsed audible signals produced by remote alarm devices and the signal on the common conductor 12.

In accordance with the present invention, the nature of the signal on common conductor 12 is shown in FIG. 3B, with respect to the pulsed audible alarm signal shown in FIG. 3A produced by the originating alarm device sensing a dangerous condition. FIG. 3C shows two, four second intervals of pulsed audible signals generated when the remote alarm device detects the positive rising pulse 6 shown in FIG. 3B on the common conductor 12. The remote sensing device generates the rising edge of pulse 6 substantially coincident with the edge of the first pulse of the second group of pulses 7 of FIG. 3A. The pulse 6 is not applied to the common conductor 12 until the second group of audible pulses 7 are generated by the sensing alarm device. In this way, remote alarm devices are not enabled to transmit the alarm signal if a brief self-test occurs at one of the alarm devices. Only if an alarm device is indicating an alarm for more than one full period of pulsed alarm pulses shown in FIG. 3A will the signal on common conductor 12 rise above three volts.

FIG. 3B illustrates voltage 6 on conductor 12 rising in synchronism with the second group of audible pulses of FIG. 3A, and each group of audible pulses 9 produced from the remotely connected alarm device. Following the first group of alarm pulses 9, produced by the remote alarm device, the voltage on conductor 12 applied by the sensing alarm device, undergoes a negatively going transition 6A for discharging the filter capacitors of each of the remote devices, and the remote devices are reset and cease signaling an alarm after providing one complete 4 second group of audible pulses. Since the conductor 12 voltage returns to above three volts, to produce a second detectable rising edge, representing a continuous alarm condition at the sensing alarm device, a second group of pulsed audible signals 10 is produced by the remote device. When the alarm condition ceases at the sensing alarm, the negative going transition of conductor 12 maintains the remote alarm devices in the reset state. Thus, the remote devices' audible pulses are effectively generated in synchronization with the sensing alarm audible pulses.

Figure 3D:
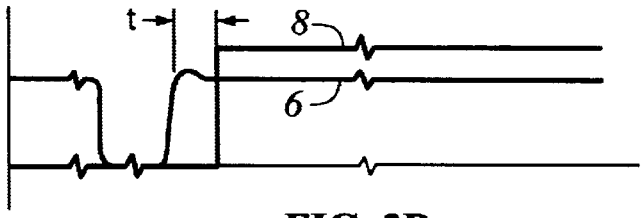
FIG. 3D illustrates the relationship between the reset portion 6A of the transmitted signal sensing alarm device and the beginning pulse 8 of each remote alarm device pulsed audible signal.

The relationship between the second group of audible pulses 7 produced by the sensing alarm and the voltage on conductor 12, represented by the circle 11, is shown more particularly in FIG. 3D. The leading pulse 8 of each remote alarm device pulsed audible alarm signal substantially coincides with the positive going edge following the negative going capacitor discharge portion of voltage 6A on the common conductor 12. As will be evident from a description of the preferred embodiment, circuitry within each of the remote alarm devices determines that the voltage level 6 is above the voltage threshold for at least a predetermined period of time t, selected in a preferred embodiment to be approximately 250 milliseconds. When this condition is satisfied, a second group of temporal pulses 10 is generated.

If the alarm condition sensed by the sensing alarm device ceases, control voltage 6 negatively transitions to produce a charge dump on the remote alarm device to its stand-by level of less than three volts, and typically zero volts, and no additional series of pulsed audible alarm signals are generated at each remote device.

Figure 4:
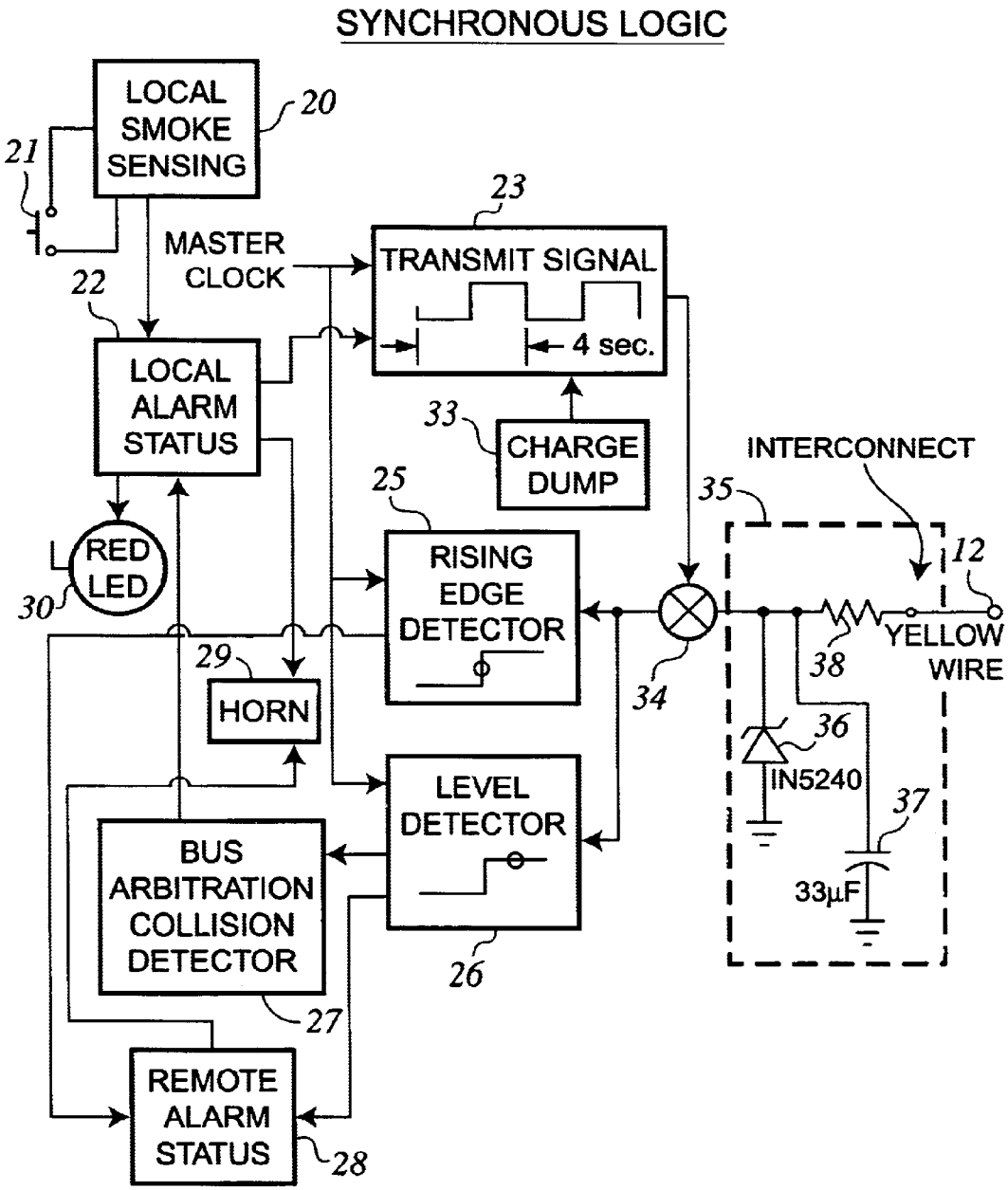
FIG. 4 illustrates the logic diagram of an alarm device in accordance with a preferred embodiment of the invention.

FIG. 4 illustrates an alarm device, in accordance with a preferred embodiment of the invention, in block diagram form, for implementing the foregoing feature. The alarm device can either originate an alarm signal on conductor 12, or receive an alarm signal on conductor 12. A local sensor 20, which in the case of a smoke detector, detects smoke particles in the air, provides a signal for activating an alarm status detector 22. If a local alarm condition has been detected, status detector 22 pulses LED 30, as well as energizes the pulsed audible signal generator 29. Pulsed audible signal generator 29 has a transducer for producing a loud audio signal comprising bursts of audible frequency signals which occur within the temporal signal format shown in FIG. 3A. As long as the local sensor 20 detects the alarm condition, a series of the pulsed audible signals will be produced from signal generator 29. Additionally, the alarm status detector 22 enables a transmit signal generator 23 to apply a voltage greater than three volts to the common conductor 12. The transmit signal generator 23 produces a voltage 6 on conductor 12 which transitions above the threshold level of three volts in synchronism and in anticipation of the leading edge of the first pulse of the second temporal pulse sequence produced from signal generator 29 and transitions negatively at substantially 50% of the alarm signal period. The voltage level is applied through a diplexer 34, and filter 35 to conductor 12. Filter 35 as explained previously in accordance with the prior art, filters any transient voltage signals which might inadvertently be coupled to conductor 12. Filter 35 includes a capacitor 37, series resistor 38, and an over voltage protection zener diode 36.

A test capability is provided through a switch 21 connected to the alarm local sensor 20. If a user entering a room in which the alarm device is located desires to test the alarm device, he may close switch 21 which will generate an alarm signal from signal generator 29, comprising the temporal pulsed audible signal of FIG. 3A. If he releases his switch 21 before a full period of temporal pulses is produced, transmit signal generator 23 will not generate a rising voltage 6 on conductor 12 for initiating alarm signals at the remote alarm devices.

In the case where the alarm device of FIG. 4 does not detect a local alarm condition, but instead receives a voltage 6 on conductor 12 indicating an alarm condition has been sensed at another alarm device, edge detector 25 will detect the leading edge of voltage 6 which is synchronized to a pulsed alarm signal generated at the sensing alarm device. Level detector 26 will determine whether the level has exceeded a threshold value, for a minimum of two sampling periods (40 ms) for the time t shown in FIG. 3D. If the condition is satisfied, a remote alarm status circuit 28 will initiate a single group of temporal pulsed audible signals from signal generator 29, which as described earlier, are in synchronism with the pulsed alarm signal produced by the alarm device sensing the alarm condition.

When the edge detector 25 and level detector 26 detect the negative going, discharge portion of voltage 6, which occurs at substantially 50% of the period of the temporal alarm signal, the input filter capacitor 37 is discharged back through the originating transmit signal generator 23 of the sensing device originating the voltage on conductor 12, and signal generator 29 is reset. When the control voltage 6 applied to the common conductor 12 rises again in response to an alarm condition at the sensing alarm device, an additional group of audible signals will be produced by the remote alarm device.

The alarm device FIG. 4 includes a bus arbitration circuit 27. Bus arbitration circuit 27 is provided, so that in the event a connected alarm device senses the same alarm condition, only one alarm device will be able to provide a transmit signal 6 through the common conductor 12. In this way, two alarm devices are kept from competing to establish synchronization among the remaining alarm devices.

The foregoing embodiment of the invention contemplates synchronizing the interconnecting alarm devices using the charge dump reset feature of the prior art. As a further design enhancement of the invention, the alarm device can be configured to initiate a transmit signal from transmit signal generator 23 which has the pattern corresponding to the temporal audible signal pattern issued by signal generator 29 to directly drive each of the interconnected alarm devices, generating an alarm pulse coincidental with each transmit signal pulse on the conductor 12.

In this embodiment of the invention, each rising edge would be detected on the conductor 12 by detector 25, and signal generator 29 would generate an audible signal temporal pulse pattern in response to each of the rising edge detections.

As a further enhancement of the device, the device could be configured so that it operates with so-called legacy alarm devices. The prior art legacy alarm devices issue a continuous DC voltage to any interconnected remote devices, thus generating asynchronous audible warning signals. In the event that a new synchronous alarm device in accordance with the foregoing embodiment was installed in such a location, for instance an additional unit necessary for a new room in a house remodeling project the level detector 26 could be set to initiate an alarm condition based on the detection of a first rising edge of voltage 6 which would then remain at a high level for the duration of the sense alarm condition. While the result would not be an alarm signal synchronous with the initiating alarm signal, it will at least provide a warning to occupants of a facility.

The foregoing description of the invention illustrates and describes the present invention. Additionally, the disclosure shows and describes only the preferred embodiments of the invention but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A method for synchronizing a series of interconnected alarm devices comprising:

generating at one of the alarm devices detecting a local alarm condition a local pulsed alarm signal having a series of repeating temporal patterns each having a plurality of pulses;

generating a signal at the one of said alarm devices detecting the local alarm condition, the signal having a distinct rising edge being generally coincident with a first rising edge of a first pulse of the temporal pattern of pulses;

detecting the rising edge of said signal at each of said remaining alarm devices; and generating a remote pulsed alarm signal having a series of repeating temporal patterns each having a plurality of pulses in response to said rising edge at each of said remaining alarm devices whereby the local pulsed alarm signal begins at substantially the same time as each of the remote pulsed alarm signals.

2. The method according to claim 1 further comprising: delaying said signal generated at said one alarm device until said one alarm device has generated a pulsed alarm signal for a fixed period of time.

3. The method for synchronizing interconnected alarm devices according to claim 1 further comprising:

detecting a falling edge of said signal which occurs within a predetermined time following said rising edge; and resetting said remaining devices when said falling edge is detected whereby said remaining devices cease emitting said pulsed alarm signal.

4. The method for synchronizing said interconnected alarm devices according to claim 1 further comprising:

continuously producing at said remaining devices a continuous pulse alarm signal until said falling edge is detected following said rising edge.

5. The method for synchronizing said interconnected alarm devices according to claim 1 wherein said pulsed alarm signal comprises three consecutive pulses having substantially equal on times, followed by a substantially longer off period.

6. The method for synchronizing according to claim 5, wherein said generated signal falling edge occurs at substantially 50% of said pulsed alarm signal duration.

7. The method for synchronizing according to claim 1 further comprising detecting whether said generated signal is at a high level for more than a predetermined time.

8. The method for synchronizing according to claim 1 further comprising determining if one of said remaining devices is applying a signal to other devices in response to a detected alarm condition; and inhibiting generation of said signal in response to a determination that a remaining device is detecting an alarm condition.

9. The method for synchronizing according to claim 8 wherein said step for determining if said remaining device is detecting an alarm condition comprises determining whether said signal having a distinct rising edge is being generated by said one alarm device.

10. An alarm device for responding to a locally generated alarm condition and to a remotely detected alarm condition detected by another alarm device that generates a pulsed audible signal having a series of repeating temporal patterns each having a plurality of pulses to indicate the alarm condition, comprising:

a sensor for detecting a local alarm condition;

a transducer for locally generating a pulsed audible signal;

a local alarm detector connected to said sensor and to said transducer for enabling said transducer to generate said pulsed audible signal in response to a detected local alarm condition; and a remote alarm device signal detector connected to receive a signal from another alarm device indicating that another alarm device is generating the pulsed audible signal, the signal having a rising edge generally coincident with the beginning of a first pulse of the temporal pattern of pulses and a falling edge, the signal detector being operable to supply a signal to said transducer for enabling said transducer to generate said pulsed audible signal in response to the detected rising edge of a first polarity received from said another alarm device, wherein the signal supplied by the remote alarm device signal detector to the transducer synchronizes the locally generated pulsed audible signal and the pulsed audible signal generated by said another alarm device.

11. The alarm device according to claim 10 further comprising a transmitter for supplying a signal to said another alarm device to enable a transducer of said another alarm device to generate said audible signal in synchronism with said locally generated audible signal.

12. The alarm device according to claim 11 wherein said transmitter signal resets said another alarm device following generation of said pulsed audible signal.

13. The alarm device according to claim 11 wherein said transmit signal is synchronized with said locally generated audible signal so that said signal has a rising edge which occurs at substantially the same time as a rising edge of said locally generated audible signal.

14. The alarm device according to claim 13 wherein said locally generated signal occurs in groups of equally spaced pulses, each of said group of pulses being separated by a period greater than a width of one of said spaced pulses.

15. The alarm device according to claim 14 wherein said transmit signal has a first rising edge synchronized with a first rising edge of a first pulse of one of said groups of said locally generated audible signal pulses and a falling edge synchronized with another pulse of said one group of locally generated audible signal pulses.

16. The alarm device according to claim 15 wherein said transmit signal first rising edge is delayed to occur following a first group of said audible signal pulses.

17. The alarm device according to claim 11 further comprising a signal diplexer for applying said transmit signal to a transmission conductor which carries said signal to said another alarm device.

18. The alarm device according to claim 10 further comprising a test switch connected to a test circuit which can be operated to generate a group of said locally generated audible signal pulses without generating said transmit signal.

19. An alarm device for responding to a locally generated alarm condition and to a remotely detected alarm condition detected by another alarm device comprising:

a sensor for detecting a local alarm condition;

a transducer for locally generating a pulsed audible signal including a series of repeating temporal patterns each including a plurality of pulses and an off period;

a local alarm detector connected to said sensor and to said transducer for enabling said transducer to generate said pulsed audible signal in response to a detected local alarm condition;

a remote alarm device signal detector connected to receive a signal from said another alarm device and to enable said transducer to generate said pulsed audible signal in response to a detected rising edge of the signal received from said another alarm device such that the locally generated pulsed alarm signal is synchronized with the pulsed audible alarm signal generated by said another alarm device; and a transmitter circuit for transmitting a transmit signal to a plurality of other alarm devices for initiating a pulsed audible signal at said other alarm devices, the transmit signal having a rising edge of a first polarity synchronized with the beginning of a first pulse of the temporal pattern of pulses for the locally generated pulsed audible signal and a falling edge synchronized with the termination of the last pulse of the temporal pattern of pulses for the locally generated pulsed audible signal such that the pulsed audible signal at said other alarm device is synchronized with a pulsed audible signal produced by said transducer in response to said local alarm condition.

20. The alarm device according to claim 19, further comprising an arbitration circuit for detecting when said remote alarm device detector is receiving the signal from said another alarm device, and inhibiting said transmitter circuit from transmitting the transmit signal to said other alarm devices when the signal from another alarm device is being received.

21. The alarm device according to claim 20, wherein said transmitter circuit produces the transmit signal having the falling edge which resets each of said other alarm devices I synchronism with said pulsed audible signal produced by said transducer.

22. The alarm device according to claim 20 further comprising a circuit for applying said transmit signal to a conductor which receives said signal from said another device.

23. The alarm device according to claim 20 wherein said another alarm signal detector comprises a level detector which inhibits the generation of an audible alarm signal if said received signal is not received for a minimum time period.

24. The alarm device according to claim 19 wherein said remote alarm device signal detector continues to enable said transducers to generate said pulsed audible signal if said signal from said another alarm device remains above a threshold voltage.

25. The alarm device of claim 19, wherein the transmit signal includes a plurality of leading edges each having a first polarity, each of the leading edges of the transmit signal being synchronized with the first pulse of each temporal pattern.

26. The alarm device according to claim 19, wherein the transmit signal from the transmitter circuit is delayed for a fixed period of time after the transducer initially generates the pulsed audible signal in response to the local.

27. The alarm device of claim 26, wherein the pulsed audible signal includes a series of repeating temporal patterns each including a plurality of pulses and an off period, wherein the leading edge of the transmit signal from the transmitter circuit is delayed until the beginning of the first pulse of the second temporal pattern.

28. The alarm device of claim 27, wherein the transmit signal includes a plurality of leading edges each having a first polarity, each of the leading edges of the transmit signal being synchronized with the first pulse of each temporal pattern.

* * * * *